United States Patent [19]

Goode et al.

[11] 4,354,113

[45] Oct. 12, 1982

[54] ION SOURCES

[75] Inventors: Philip D. Goode, Didcot; Michael J. Poole, Abingdon; Gordon W. Proctor, Didcot, all of England

[73] Assignee: United Kingdom Atomic Energy Authority, London, England

[21] Appl. No.: 221,308

[22] Filed: Dec. 30, 1980

Related U.S. Application Data

[63] Continuation-in-part of Ser. No. 23,745, Mar. 26, 1979, abandoned.

[30] Foreign Application Priority Data

Apr. 5, 1978 [GB] United Kingdom ..... 13310/78

[51] Int. Cl.³ ..... H01J 27/00

[52] U.S. Cl. ..... 250/423 R; 313/363.1

[58] Field of Search ..... 250/324, 325, 326, 423 R, 250/424, 425, 426, 421; 313/359, 363

[56] References Cited

U.S. PATENT DOCUMENTS

| | | | |
|---|---|---|---|
| 3,411,035 | 11/1968 | Necker et al. | 313/210 |
| 3,784,858 | 1/1974 | Franks | 313/210 |
| 3,831,052 | 8/1974 | Knechtli | 313/209 |
| 3,944,873 | 3/1976 | Franks | 313/206 |

FOREIGN PATENT DOCUMENTS

| | | |
|---|---|---|
| 1158782 | 7/1969 | United Kingdom . |
| 1414626 | 11/1975 | United Kingdom . |

*Primary Examiner*—Bruce C. Anderson

*Attorney, Agent, or Firm*—Larson and Taylor

[57] ABSTRACT

An ion source comprises a cylindrical chamber having a longitudinal exit slit formed therein and two parallel anode wires extending the length of the chamber in the central region thereof and symmetrically disposed with respect to the longitudinal axis of the chamber and the exit slit, wherein at each end of the exit slit there is positioned at or near the zero potential equipotential a mask, the separation of the inner ends of the masks defining the width of the ion beam emitted by the source.

10 Claims, 6 Drawing Figures

Figure 1A:
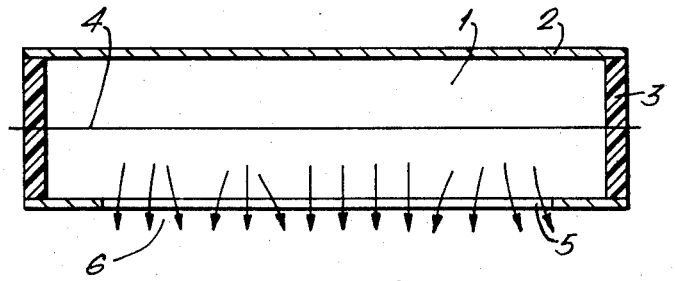

Fig. 3(a)
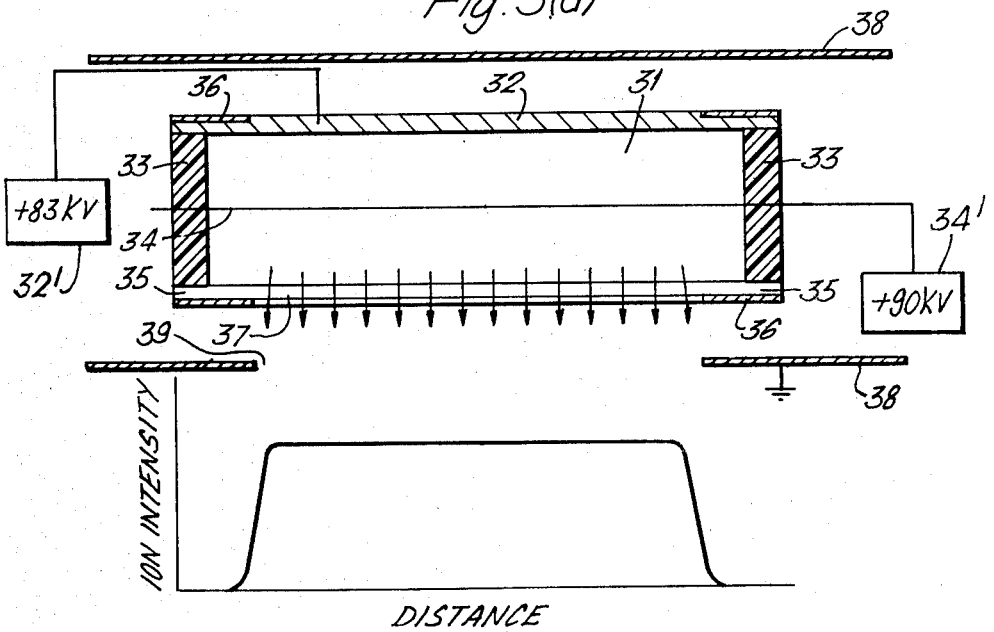
Fig. 3(b)
Fig. 4(a)
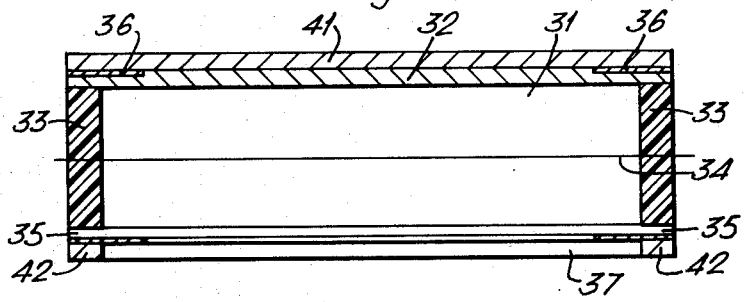
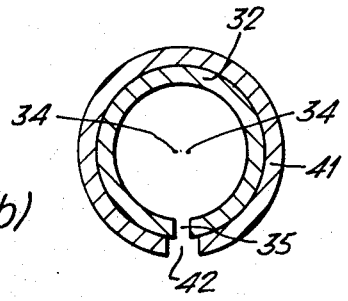
Fig. 4(b)

ION SOURCES

CROSS REFERENCE TO RELATED APPLICATIONS

This application is a continuation-in-part of application Ser. No. 23,745, filed on Mar. 26, 1979, now abandoned.

The present invention relates to ion sources, and specifically to twin anode ion sources, that is to say, to ion sources consisting of a cylindrical chamber having two parallel anode wires symmetrically disposed with relation to its longitudinal axis and a longitudinal exit slit for ions produced within the chamber. In use the source is mounted in an evacuated chamber in which the pressure has been reduced to a level such the ions will propagate as a beam.

When a potential difference of some kilovolt is applied between the chamber of such a source and its anode wires, electrons which are present in residual gas within the chamber follow oscillatory paths towards the anode wires, so creating positive ions within the residual gas. The ions from the resulting gas discharge bombard the walls of the chamber preferentially in two opposed regions. By arranging for an exit slit to be situated at one of the prime bombardment sites, a beam of positive is caused to issue from the source.

The principles of the operation and construction of such sources are described more fully in the following publications: U.K. Pat. Nos. 1,158,782, 1,414,626 (corresponding to U.S. Pat. No. 3,784,858) and Journal of Physics D. Vol. 3, 1970, p.p. 1399–1402.

Such a source produces a beam of ions proceeding radially outwards from the anodes towards the exit slit. The presence of the exit slit distorts the electric field near to the outer boundary of the chamber, and so causes deviations in the paths of the ions as they travel away from the exit slit.

These distortions in the ion paths are not of great consequence in the major part of the exit slit, but at the ends of the exit slit, an undesirable effect does occur. Field perturbations at these points cause the ions to have velocity components parallel to the slit. Thus the ends of the ion beam become diffuse, and also the ion density along the ion beam is variable. The rectification of these effects by means of external electrodes is difficult. Also, if an attempt is made to imitate an infinite slit by extending the slit beyond the region in which ions are produced by the anode wires, then extended tails in the ion density are produced at the ends of the ion beam. Although these can be shielded off externally, this can be a nuisance, and particularly so when a further accelerating field is used.

According to the present invention there is provided an ion source comprising a cylindrical chamber having a longitudinal exit slit formed therein and two parallel anode wires extending the length of the chamber in the central region thereof and symmetrically disposed with respect to the longitudinal axis of the chamber and the exit slit, wherein at each end of the exit slit there is positioned a mask at or near a substantially electric field free region within the exit slit, the separation of the inner ends of the masks defining the width of the ion beam emitted by the source.

In a preferred embodiment of the invention for use in a system including a cylindrical accelerating electrode surrounding the chamber and having the same axis of symmetry as the chamber, the wall thickness of the chamber is sufficient to ensure that there is a substantially electric field free region in the thickness of the wall of the chamber, the masks are positioned to be in the electric field free region, the profile of the exit slit has a stepped configuration with the wider portion of the slit on the outside, and the width of the wider part of the slit is not substantially greater than the radial depth of the outer part of the exit slit.

The source may also include a separate liner which can be used to provide a source of a material ions of which are to be produced by the source.

Figure 1B:
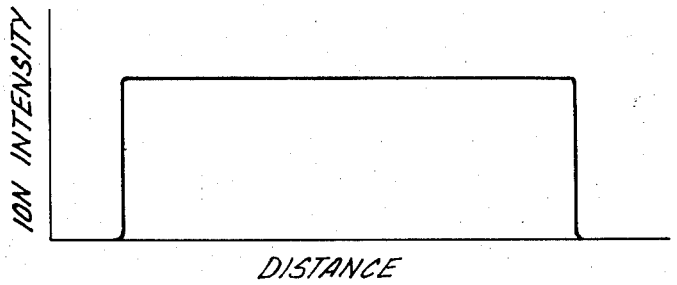
Figure 1C:
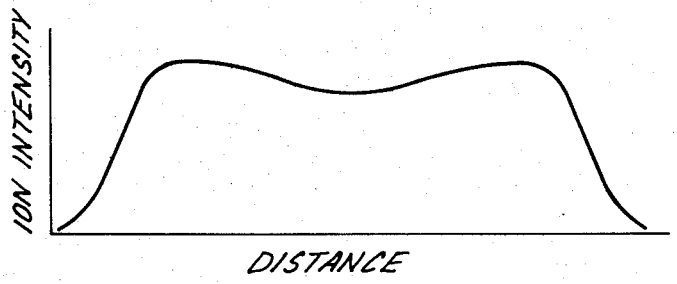
PRIOR ART Fig. 1(c)

The invention will now be described and explained by way of example, with reference to the accompanying drawings, in which:

FIG. 1(*a*) shows a longitudinal section of a conventional twin anode ion source, the FIG. 1(*b*) shows desired form of ion beam, and FIG. 1(*c*) shows that actually emitted by the source.

Figure 2A:
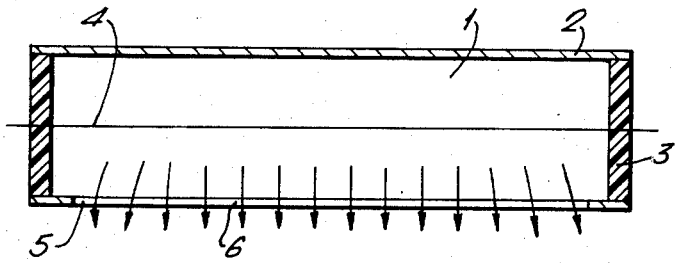
Figure 2B:
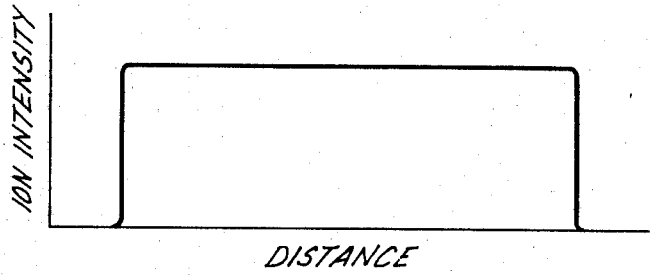
Figure 2C:
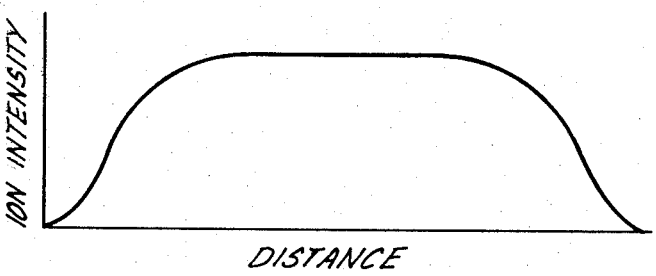
PRIOR ART Fig. 2(c)
Figure 5:
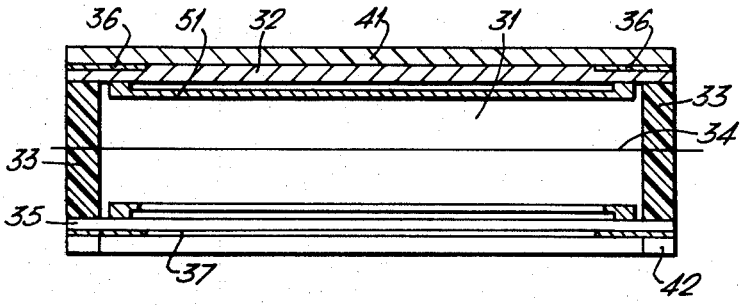
Figure 6:
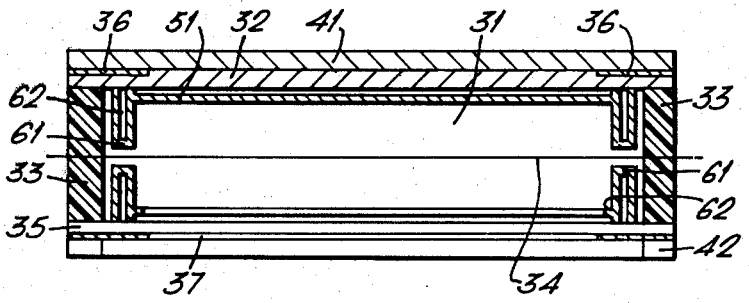

FIG. 2(*a*) shows a modified version of the ion source of FIG. 1(*a*), and FIG. 2(*b*) and 2(*c*) show its effect upon the emitted ion beam, FIG. 3(*a*) shows a longitudinal section of an ion source embodying the invention, and FIG. 3(*b*) shows the form of the ion beam produced by the source, FIGS. 4(*a*) and 4(*b*) are, respectively, longitudinal and cross sectional views of an ion source embodying the invention for use with an external field-forming electrode, FIG. 5 shows a longitudinal section of another ion source embodying the invention, and FIG. 6 shows a longitudinal section of a modified version of the ion source of FIG. 5.

Referring to FIG. 1(*a*), a conventional twin anode ion source consists of a cylindrical chamber 1 formed by a metal tube 2 with insulating end plugs 3 inserted in it. Two anode wires 4, of which one is shown, are supported by the insulating end plugs 3 and are symmetrically disposed with reference to the longitudinal axis of the chamber 1 and an exit slit 5 the axial length of which defines the nominal width of a beam of ions 6 produced by the source.

A plot of the desired density distribution within the ion beam 6 is shown in FIG. 1(*b*), and a plot of the ion density distribution actually produced is shown in FIG. 1(*c*) of the desired ion density distribution.

The effect, previously referred to, of the ends of the exit slit 5 is clearly shown in FIG. 1(*c*).

FIG. 2(*a*) to 2(*c*) shows what happens if one tries to eliminate the effects of the ends of the slit 5 by extending it beyond the region of the chamber 1 where the ions emitted by the source are generated. Again the tails in the ion distribution are clearly shown in FIG. 2(*a*).

FIG. 3(*a*) shows a twin anode ion source embodying the invention. The source consists of a main chamber 31 formed by a stainless tube 32 fitted with insulating end plugs 33 which support two central anode wires 34, as in a conventional twin anode ion source. The tube 32 is some 5" in length, 2" in internal diameter, with a wall thickness of $\frac{1}{8}$". A slot 35 $\frac{1}{8}$" wide extends the length of the tube 32. At each end of the tube 32 there is provided a ring 36 of stainless steel 0.015" in thickness and extending axially a distance equal to the internal radius of the main chamber 31. The rings 36 and slot 35 define an exit slit 37. The dimensions quoted ensure that the ends of the masks formed by the rings 36 are in the region of zero electric field when the source is in operation. The ends of the tube 32 are relieved to receive the rings 36 so that the external diameter of the tube 32 is the same throughout the length of the source.

The chamber 31 is surrounded by an extraction electrode 38 which has a slot 39 in it which is aligned with the exit slit 37 of the chamber 31.

In use a potential difference of some 10 kv is established between the anode wires 34 and the tube 32, which itself is maintained at a potential of some tens of kilovolts with respect to the extraction electrode 38. For example, a potential of +90 kv may be applied to the anode wires 34 from a source 34' while a potential of +83 kv is applied to the tube 32 from a source 32', and the extraction electrode 38 is earthed.

The ion distribution in the ion beam produced by the source also is shown in FIG. 3(*b*). It can be seen that a considerable improvement has been achieved.

If an ion source such as that described is used with a system of co-axial cylindrical accelerating electrodes, then the electric field due to at least the nearest accelerating electrode will penetrate into the exit slit 37 of the ion source. The electric field due to the accelerating electrodes will be much greater than that within the source chamber 31 due to the twin anode wires 34. As a result, the disturbing effects on the ion beam will be much greater; indeed, in extreme cases the cross-section of the ion beam may be made elliptical, or even circular.

FIG. 4 shows two views of an ion source embodying the invention for use with external accelerating electrodes. The wall thickness of the main chamber 31 is increased to a thickness such that there is a field-free region approximately half way through the wall of the chamber 31, and the masks 36 are positioned in this region, as before. The most convenient way of doing this is to take a source such as that described with reference to FIG. 3, and insert it in a close fitting outer tube 41 of appropriate thickness which has a slot 42 in it which is positioned to register with the slit 37 of the basic source. The slot 42 is made to be longer than the exit slit 37.

An advantageous focussing effect on the ion beam can be achieved if the width of the slot 42 is made to be greater than that of the slit 37. To ensure that the region of space at the outer edge of the slit 37 is relatively field-free, the width of the slot 42 should not be greater than about twice the wall thickness of the outer tube 41.

In use, as has been described, the twin anode ion source produces two internal beams of ions from residual gas with the chamber. One of these flows towards and through the exit slit 37. The other flows in the diametrically opposite direction and impinges on the internal wall of the tube 32, where it produces heat and erodes the material of the tube 32. In addition, the emerging beam of ions erodes the edges of the exit slit 37. FIG. 5 shows an ion source embodying the invention in which there is included a loose liner 51 which readily can be changed when it becomes damaged in use. The liner 51 can be made of the same material as the tube 32 which forms the wall of the main chamber 31, or it can be made of a material which is chosen for properties of its own. For example, it can be made of a material which is more resistant to erosion than the material out of which the tube 32 is made, or it can be made of a material which will be sputtered by the ions impinging on it so as to provide ions of that material in the ion beam produced by the source. For example, graphite is very resistant to erosion by sputtering, whereas yttrium will yield sufficient ions for an appreciable quantity of such ions to be emitted by the source. Also, it can be made of a material which normally is solid, but which will have an appreciable vapour pressure at the temperatures reached by the source in operation, again providing ions of that material in the ion beam produced by the source. The liner 51 shown in FIG. 5 is adapted to act in this way. In order to ensure that the liner 51 reaches the desired temperature, its thickness is reduced over the major part of its length, so that the thermal contact between the liner 51 and the wall of the tube 32 is reduced. For example, a liner 51 of this form made of Cu will run at a temperature of some 800° C. and produce $Cu^+$ions.

FIG. 6 shows a modification of the ion source of FIG. 5 in which the liner 51 has thickened field-defining end plates 61. Cavities 62 are drilled in the end plates 61 to hold a desired material to be vaporised at the temperature at which the source operates. For example, ion beams containing phosphorus ions have been produced in this way by filling the cavities 62 with phosphorus.

We claim:

1. An ion source comprising a chamber including an electrically conducting cylindrical tube having a longitudinal exit slit formed therein, the thickness of the wall of the chamber being sufficient to ensure that, in use, there is a substantially electric field free region within the exit slit, two parallel anode wires extending the length of the chamber in the central region thereof and being symmetrically disposed with respect to the longitudinal axis of the chamber and the exit slit, and a mask positioned at each end of the exit slit so as to have an edge in the electric field free region within the exit slit, the separation of the opposing edges of the masks defining the width of the ion beam emitted by the source.

2. An ion source according to claim 1 wherein the profile of the exit slit has a stepped configuration with the wider part of the slit on the outside of the wall of the chamber, and the width of the wider part of the exit slit is not substantially greater than the radial depth of the outer part of the exit slit.

3. An ion source according to claim 2, wherein the wider part of the exit slit has a width of twice the radial depth of the said part of the exit slit.

4. An ion source according to any one of claims 1 2 or 3 wherein the wall of the chamber is made of an outer portion and an inner portion and the masks are positioned between the inner and outer portions.

5. An ion source according to any one of claims 1, 2 or 3 wherein there is included a lining positioned adjacent to the inner surface of the cylindrical chamber in the region opposite to the exit slit and which is replaceable to enable any erosion which takes place in use to be rectified.

6. An ion source according to claim 5 wherein at least a portion of the lining is made of a material which produces ions and is arranged to provide said ions, the ions of said material being provided in the ion beam of the ion source.

7. An ion source according to claim 6 wherein the ions are produced by sputtering from the said material.

8. An ion source according to claim 6 wherein the ions are produced by the vaporization of the said material.

9. An ion source according to claim 5 wherein the lining includes end-pieces which extend radially inwards and which further define the electric field within the chamber of the ion source.

10. An ion source according to claim 9 wherein the end pieces are adapted to include a material which produces ions, and is arranged to provide said ions, the ions of said material being provided in the ion beam of the ion source.

* * * * *